US009573393B2

(12) United States Patent
De Roeck

(10) Patent No.: US 9,573,393 B2
(45) Date of Patent: Feb. 21, 2017

(54) MOVABLE VACUUM DIVIDER

(71) Applicant: AGFA GRAPHICS NV, Mortsel (BE)

(72) Inventor: Luc De Roeck, Mortsel (BE)

(73) Assignee: AGFA GRAPHICS NV, Mortsel (BE)

( * ) Notice: Subject to any disclaimer, the term of this patent is extended or adjusted under 35 U.S.C. 154(b) by 0 days.

(21) Appl. No.: 15/027,522

(22) PCT Filed: Oct. 30, 2014

(86) PCT No.: PCT/EP2014/073330
§ 371 (c)(1),
(2) Date: Apr. 6, 2016

(87) PCT Pub. No.: WO2015/067520
PCT Pub. Date: May 14, 2015

(65) Prior Publication Data

US 2016/0257141 A1 Sep. 8, 2016

(30) Foreign Application Priority Data

Nov. 5, 2013 (EP) ..... 13191495.4

(51) Int. Cl.
*B41J 2/01* (2006.01)
*B41J 11/00* (2006.01)
*B65H 5/22* (2006.01)

(52) U.S. Cl.
CPC ..... *B41J 11/0085* (2013.01); *B41J 11/007* (2013.01); *B65H 5/224* (2013.01); *B65H 2401/242* (2013.01); *B65H 2404/281* (2013.01); *B65H 2406/322* (2013.01); *B65H 2406/3222* (2013.01)

(58) Field of Classification Search
CPC ... B65H 5/224; B65H 29/242; B65H 2406/30; B65H 3/124; B65H 2406/3223; B65H 2406/33; B65H 2406/32; B65H 2406/322; B65H 2406/3222; B65H 2401/242; B65H 2404/281; B41J 11/0085; B41J 11/007; B41J 11/06; B41J 13/226
USPC ..... 347/16, 101, 104
See application file for complete search history.

(56) References Cited

U.S. PATENT DOCUMENTS

| | | | | |
|---|---|---|---|---|
| 3,527,166 | A | 9/1970 | Jaffa et al. | |
| 4,792,249 | A | 12/1988 | Lahr | |
| 2005/0128276 | A1* | 6/2005 | Yamada | B41J 11/0085 347/104 |
| 2008/0073838 | A1* | 3/2008 | Sakaida | B41J 11/007 271/276 |

(Continued)

FOREIGN PATENT DOCUMENTS

| | | | |
|---|---|---|---|
| DE | 10 2010 049 258 | A1 | 4/2012 |
| EP | 1 905 710 | A2 | 4/2008 |

(Continued)

OTHER PUBLICATIONS

Official Communication issued in International Patent Application No. PCT/EP2014/073330, mailed on Jan. 27, 2015.

*Primary Examiner* — Jannelle M Lebron
(74) *Attorney, Agent, or Firm* — Keating and Bennett, LLP

(57) ABSTRACT

An inkjet printer system includes a porous printing table and thereunder a vacuum chamber that may be divided into sub-vacuum chambers by a movable vacuum divider and a brush attached to prevent contamination and vacuum leakages in the vacuum chamber.

10 Claims, 10 Drawing Sheets

(56) References Cited

U.S. PATENT DOCUMENTS

| | | | | |
|---|---|---|---|---|
| 2010/0213666 | A1 | 8/2010 | Harney et al. | |
| 2010/0271425 | A1 | 10/2010 | Bober | |
| 2013/0162742 | A1* | 6/2013 | Inoue ..... | B41J 11/0085<br>347/104 |

FOREIGN PATENT DOCUMENTS

| | | | |
|---|---|---|---|
| JP | 2005-096135 | | 4/2005 |
| JP | 2010-149310 | A | 7/2010 |
| JP | 2013-132789 | A | 7/2013 |

* cited by examiner

MOVABLE VACUUM DIVIDER

CROSS-REFERENCE TO RELATED APPLICATIONS

This application is a 371 National Stage Application of PCT/EP2014/073330, filed Oct. 30, 2014. This application claims the benefit of European Application No. 13191495.4, filed Nov. 5, 2013, which is incorporated by reference herein in its entirety.

BACKGROUND OF THE INVENTION

1. Field of the Invention

The present invention relates to an inkjet printing system which comprises a vacuum chamber underneath a printing table that creates multiple vacuum zones on the top of the printing table by a movable vacuum divider.

2. Description of the Related Art

To create multiple variable vacuum zones on the top of a printing table to hold several pieces of substrate, several methods and systems are known in the state of the art.

An example of such a system for either typewriters or printers is disclosed in U.S. Pat. No. 4,792,249 (CREATIVE ASSOCIATES LIMITED PA) wherein the vacuum chamber is sectored so that the reduced air pressure is applied only in the region which communicates with the paper to be printed by consecutive sectoring walls, as movable vacuum dividers, which are slidable in the vacuum chamber.

Another example of such a system for an image printing device such as an inkjet printer is disclosed in US 2010/0213666 (XEROX CORPORATION) wherein a vacuum chamber is located underneath a porous conveying belt that that varies the vacuum zones in size and position on the porous conveying belt and wherein a movable wall, as movable vacuum divider, is disclosed to adjust the vacuum zones based on the width of the substrate.

DE 102010049258 (WEMHOENER SURFACE GMBH) discloses also a system for a digital printer wherein a vacuum chamber is used with movable partitions that can be adjusted according the width of workpieces that need to be printed by movable vacuum dividers.

In a production environment while using an inkjet printing system, that is capable of creating vacuum zones, contaminations such as paper dust, substrate fibers, ink, ink residues and/or ink debris such as cured ink, contaminate the inner surface of the air channels in the porous printing table and the inner surface of the set of apertures in the bottom surface of the porous printing table, the inner surface of the vacuum chamber and thus also a movable vacuum divider inside the vacuum chamber. These contaminations need to be cleanable in the vacuum chamber itself without creating vacuum leakages else uncontrolled movement of the movable vacuum divider may occur due to obstacles of the contaminations.

It is besides not uncommon that while changing the inkjet printheads in the inkjet printing systems results in a loss of ink on the printing table or that an inkjet printhead is blocked and results in an overfill and a loss of ink on the printing table.

An approach to eliminate this problem is by periodically removing the printing table from the vacuum chamber and if necessary the wrapped conveying belt around the printing table. However this approach results in a significant downtime for the print system, as printing must be halted in order to remove the printing table from the inkjet print device.

An example of a cleaning system in a printing table is disclosed at US 2010/0271425 (XEROX CORPORATION) wherein the vacuum chamber may be configured a vacuum pressure and vacuum exhaust to clean clogged holes in the conveying belt.

There is still a need to provide an inkjet printing system that avoids contamination such as paper dust, substrate fibers, ink, ink residues and/or ink debris such as cured ink in the vacuum chamber to prevent the bad working of a movable vacuum detector in the vacuum chamber and to prevent vacuum leakages.

SUMMARY OF THE INVENTION

A preferred embodiment of the invention of the inkjet printer system comprises a porous printing table comprising:

- a vacuum chamber underside the porous printing table to couple a substrate to the porous printing table;

and wherein the porous printing table comprises:

- a set of air channels; and
- a bottom surface comprising a set of apertures which are connected to one or more air channels of the set of air channels;

and wherein the vacuum chamber comprises inside:

- a movable vacuum divider to divide the vacuum chamber in a plurality of sub-vacuum chambers;

and wherein a sub-vacuum chambers comprises:

- a sub-vacuum chamber controller to pull vacuum through a part of the set of air channels and to create a vacuum zone on the top surface of the porous printing table; and wherein the movable vacuum divider comprises:
- a brush, touching the inner surface of the vacuum chamber and the bottom surface of the porous printing table.

The movable vacuum divider results in a plurality of vacuum zones on the printing table. The brush gives an advantage of less or no contamination in the vacuum chamber and less or no vacuum leakage at the movable vacuum divider.

The plurality of vacuum zones creates the possibilities to jet different sized substrates and/or to jet multiple substrates simultaneous. This is an enormous advantage in the production of inkjet printed substrates with the inkjet printing system of a preferred embodiment.

Another preferred embodiment of the invention describes an inkjet printing method with the following steps:

- dividing the printing zone on a porous printing table with a plurality of air channels in separate vacuum zones; and
- moving a movable vacuum divider inside a vacuum chamber, positioned underside the porous printing table, to divide the vacuum chamber in a plurality of sub-vacuum chambers;
- touching the inner surface of the vacuum chamber and the bottom surface of the porous printing table by a brush, attached to the movable vacuum divider;
- supplying vacuum in one of the plurality of sub-vacuum chambers.

A preferred embodiment of the inkjet printer may have a movable wall as movable vacuum divider, parallel to the width of the porous printing table, to divide the vacuum chamber in two sub-vacuum chambers so you a get a row of two sub-vacuum chambers along the length of the vacuum divider (FIG. 9).

The inkjet printer may have a pre-tensioning system that pushes the brush against the wall of the first vacuum chamber and/or the bottom surface of the porous printing table with a force in the range of 0.1 N to 50.0 N and more preferred in the range of 0.05 N to 20 N and most preferred a force from 0.01 N to 200 N.

The pre-tensioning system, such as for example a spring, attached to the brush, gives a bigger advantage of less or no contamination in the vacuum chamber and less or no vacuum leakage at the movable vacuum divider. It pushes with carefully controlled pressure against the inner surface of the vacuum chamber and the bottom surface of the porous printing table.

The brush may be a carpet fabric wherein the carpet fabric may have a pile composed of yarn tufts in loop and/or cut configuration and/or wherein the height of pile is from 0.5 mm to 20 mm and/or wherein the fabric density of the carpet fabric is from 1000 until 100000 filaments per $cm^2$ and/or wherein the pile is composed of polytetrafluoroethylene (PTFE), polypropylene (PP), polyurethane, polyester, aromatic polyamides (ARAMID), rayon, acrylic, cellulose, viscose or nylon.

The advantage of using a carpet fabric as brush is the easy attaching of the carpet fabric to the movable vacuum divider. The carpet fabric may be attached by glue and/or by screws. The backing of the carpet fabric can easily bended around the edges of the movable vacuum divider which makes the construction of the inkjet printing system easier and faster.

The carpet fabric may also be used to clean the apertures of the bottom surface by touching a part of the pile in the inner surface of the apertures of the bottom surface. To prevent that the hairs of the brush in a preferred embodiment of the inkjet printing system shall be broken and/or shall be cut-off when touching the inner surface of a one of the apertures in the bottom surface of the porous printing table, preferably the aperture is rounded at the edge of the aperture.

BRIEF DESCRIPTION OF THE DRAWINGS

FIG. 1 also illustrates a belt step conveyor system for moving the conveyor belt (1) and to carry the substrate (4) on the conveyor belt forward in the conveying direction (5) from a start location (40) to an end location (41) by successive distance movements. The drive system which is not shown in this figure moves a first belt gripper (61) by a linear movement system (7) to a home position (8) and an end position (9) while the first belt gripper (61) engages the conveyor belt (1) and the second belt gripper (60) released the conveyor belt (1).

Figure 12:
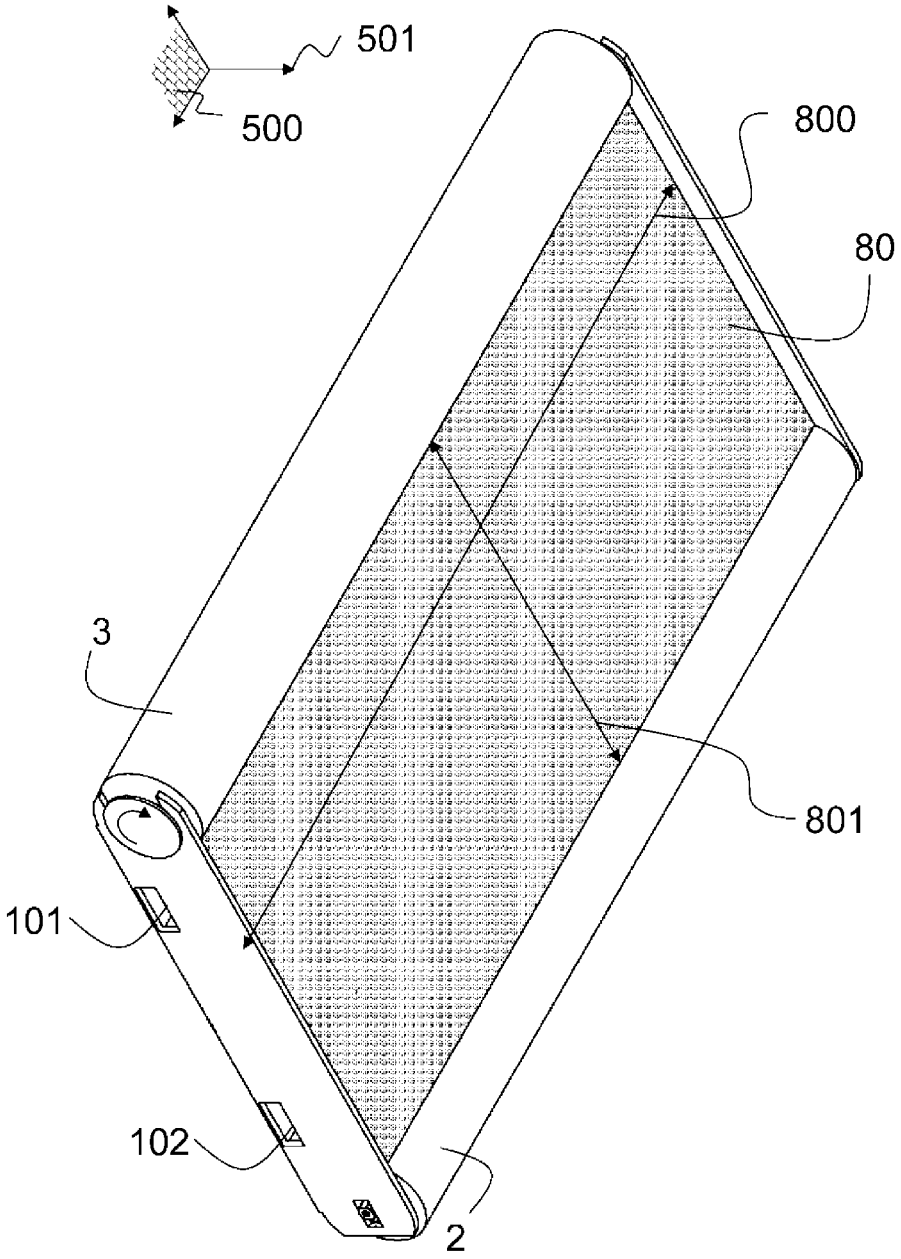

If the porous conveying belt (1) is removed as in FIG. 12, the porous printing table (80) is visible. The width of the porous printing table is indicated by an arrow (801) and the length of the porous printing table is indicated by an arrow (800). To easily manufacturing the inkjet printing system two apertures (101, 102) are provided to accept a fork of a fork-truck.

Figure 13:
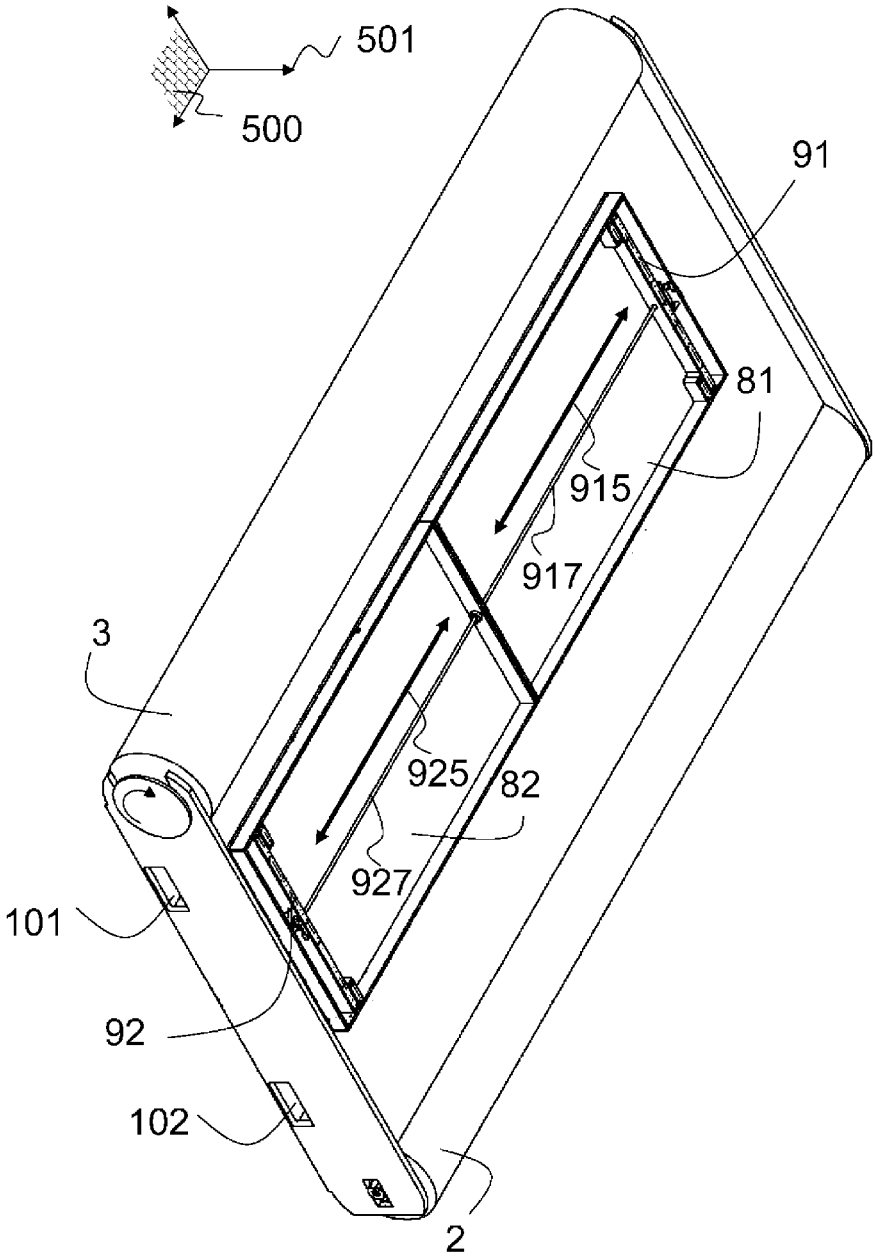

If the porous printing table (80) and porous conveying belt (1) is removed as in FIG. 13, two vacuum chambers (81, 82) are visible wherein in each of them a movable vacuum divider (91, 92) is comprised which is wrapped by a brush. The movable vacuum dividers moves (915, 925) along a rotating screw in a travelling-nut linear actuator. The rotating screw in each vacuum chamber (81, 82).

Figure 14:
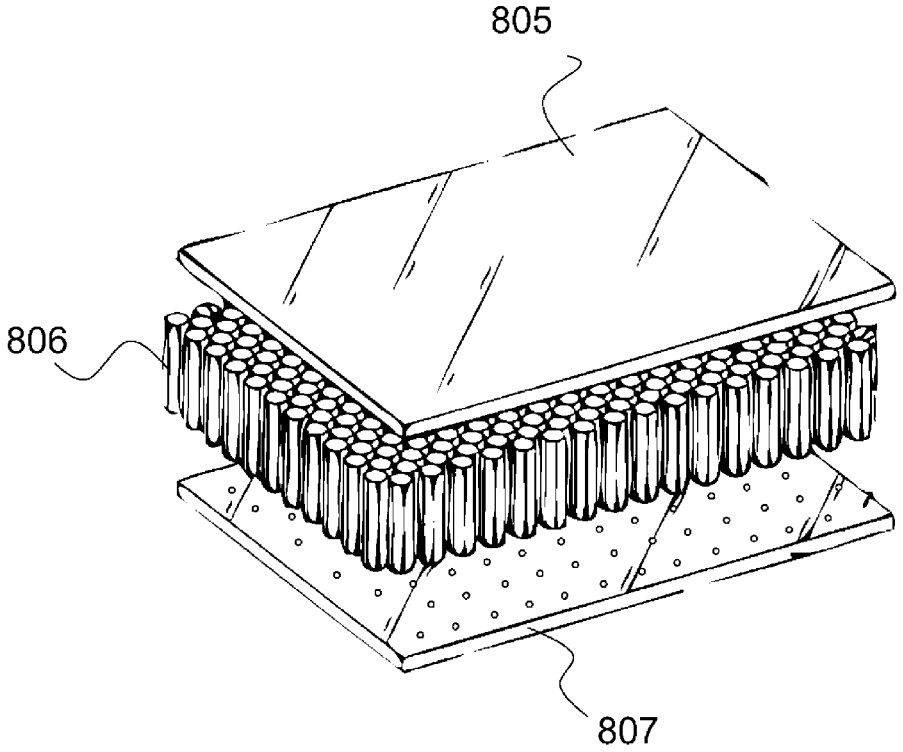

FIG. 14 illustrates a porous printing table in a preferred embodiment of the inkjet printing system wherein a honeycomb structure plate (806) with a plurality of honeycomb cores is sandwiched by two plates (805, 807) wherein the bottom plate (807) comprises a plurality of apertures to form apertures in the bottom layer of the porous printing table.

Figure 15:
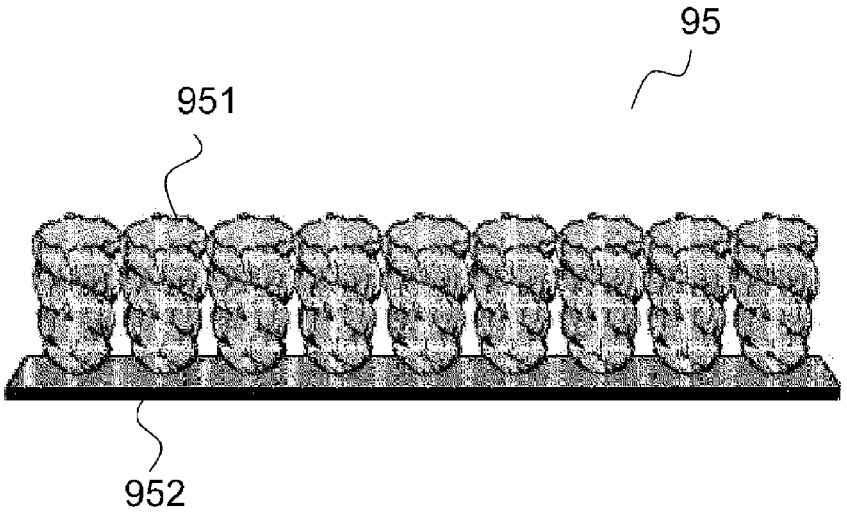

FIG. 15 illustrates a part of a carpet fabric (95) wherein the yarn tufts (951), attached to a carpet-backing fabric (952) are in a cut configuration.

Figure 16:
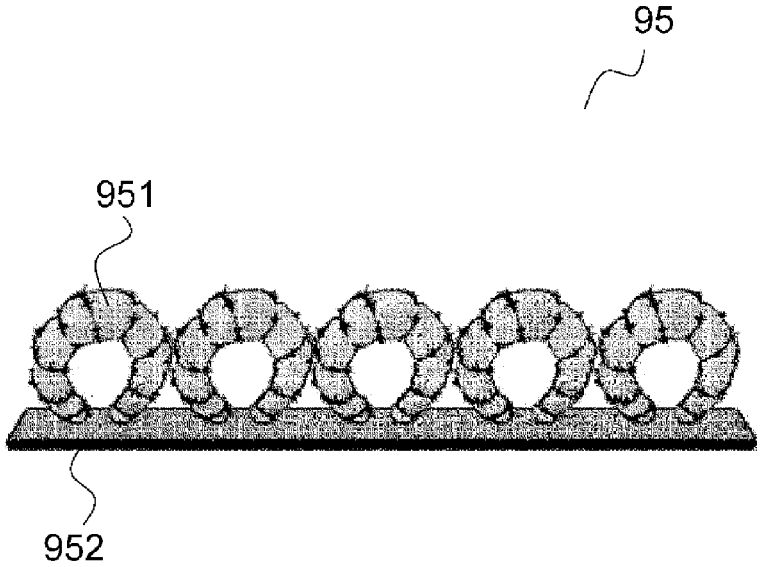

FIG. 16 illustrates a part of a carpet fabric (95) wherein the yarn tufts (951), attached to a carpet-backing fabric (952) are in a loop configuration.

DETAILED DESCRIPTION OF THE PREFERRED EMBODIMENTS

Inkjet Printing System

Inkjet printing systems, such as an inkjet printer, is a marking device that is using an inkjet print device (43) or valve-jet print device, such as an inkjet print head, page-wide inkjet arrays or an inkjet head assembly with one or more inkjet print heads, which jet ink on an ink-receiver such as a substrate. A pattern that is marked by jetting of the inkjet printing system on a substrate (4) is preferably an image. The pattern may have an achromatic or chromatic colour.

A preferred embodiment of the inkjet printing system is that the inkjet printing system is an inkjet printer and more preferably a wide-format printer. Wide-format printers are generally accepted to be any inkjet printer with a print width over 17". Digital printers with a print width over the 100" are also super-wide printers or grand format printers. Wide-format printers are mostly used to print banners, posters, textiles and general signage and in some cases may be more economical than short-run methods such as screen printing. Wide format printers generally use a roll of substrate rather than individual sheets of substrate but today also wide format printers exist with a printing table whereon substrate is loaded.

Figure 4:
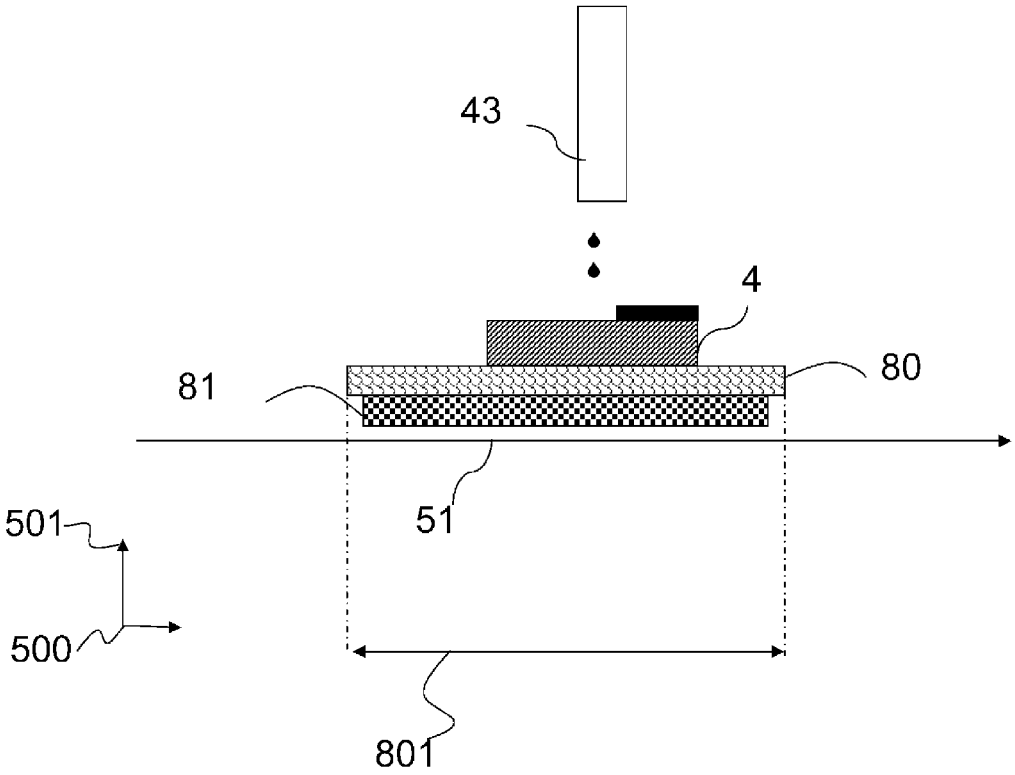
FIG. 4 illustrates a preferred embodiment of the inkjet printing system wherein the porous printing table (80) is moved in a direction (51) to print by an inkjet print device (43) the substrate (4) that is coupled to the porous printing table (4). Underneath the porous printing table (80) a vacuum chamber (81) is comprised to provide a vacuum pressure to couple the substrate (4) to the porous printing table (80). The arrow (501) defines the direction from ground (500) to top. The double arrow (801) illustrates the width of the porous printing table (80).
Figure 5:
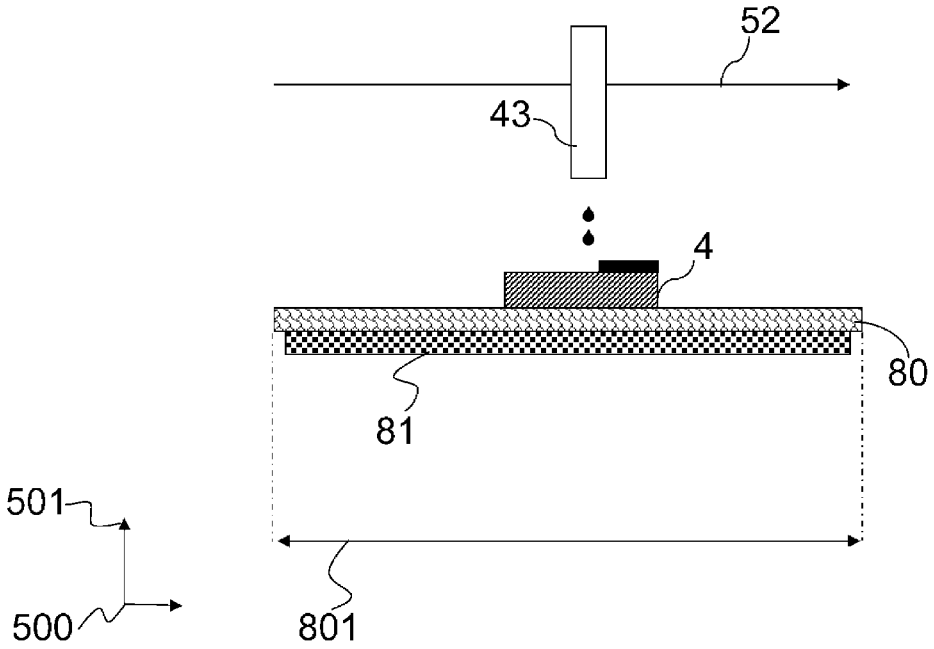
FIG. 5 illustrates a preferred embodiment of the inkjet printing system wherein the An inkjet printing device (43) is moved in a direction (52) above the porous printing table (80) to print the substrate (4) that is coupled to the porous printing table (4). Underneath the porous printing table (80) a vacuum chamber (81) is comprised to provide a vacuum pressure to couple the substrate (4) to the porous printing table (80). The movable vacuum divider inside the vacuum chamber (81) is not shown. The arrow (501) defines the direction from ground (500) to top. The double arrow (801) illustrates the width of the porous printing table (80).
Figure 6:
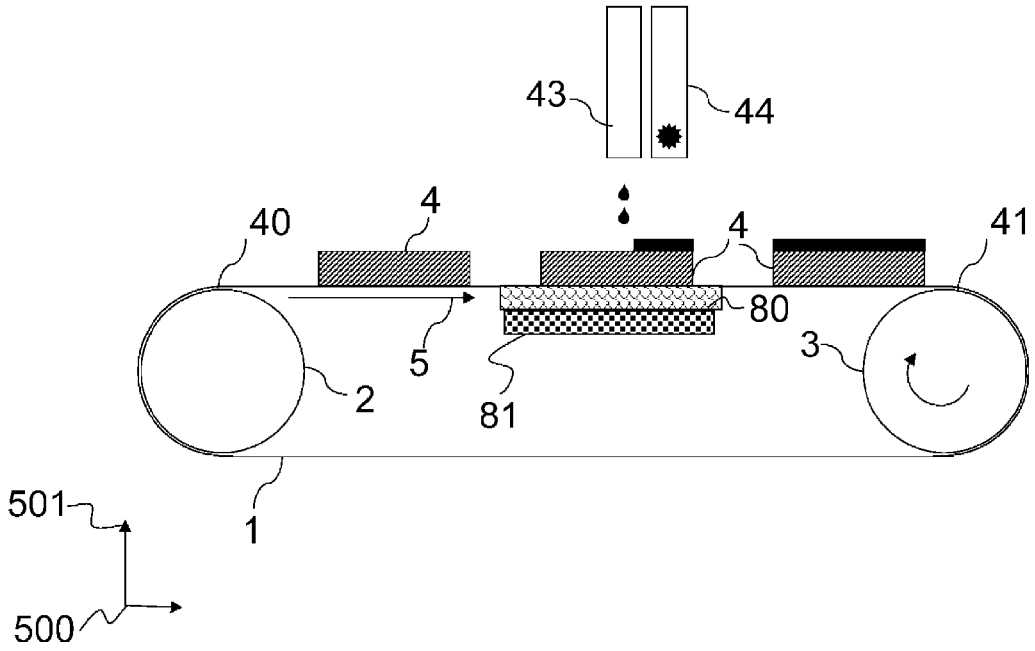
FIG. 6 illustrates a preferred embodiment of the inkjet printing system wherein the porous printing table (80) is wrapped by a porous conveying belt (1) which is linked by two pulleys (2, 3). Most parts are similar as FIG. 2. The inkjet print device (43) is jetting an UV curable liquid on the substrate and the inkjet printing system comprises an UV-dryer (44) to cure the ink on the substrate (4).
Figure 7:
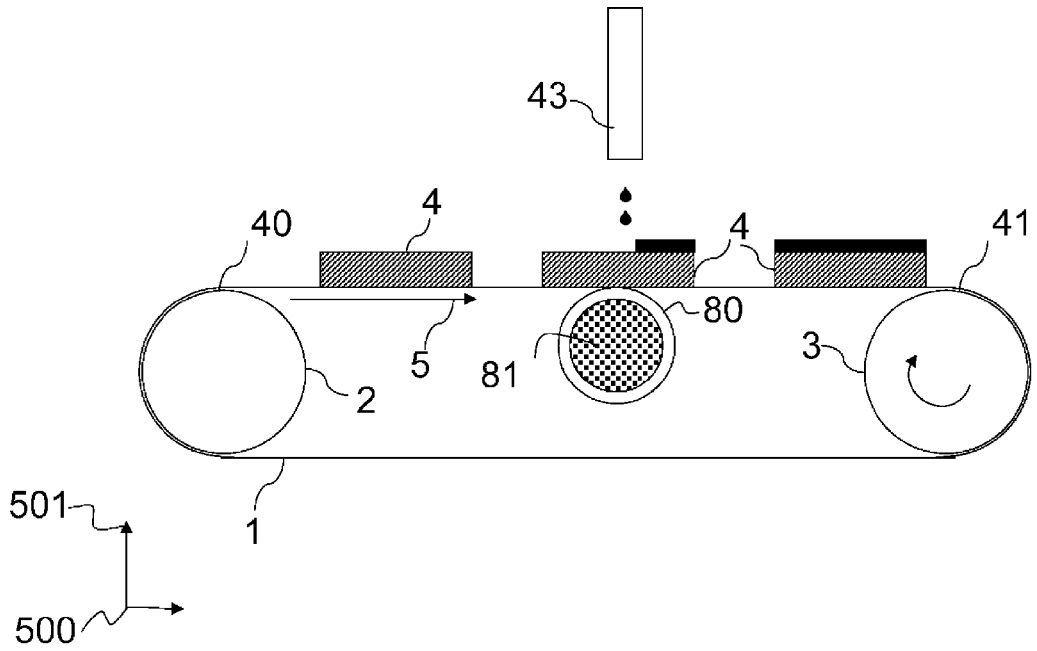
FIG. 7 illustrates a preferred embodiment of the inkjet printing system wherein the porous printing table (80) is wrapped by a porous conveying belt (1) which is linked by two pulleys (2, 3). The porous printing table (80) in FIG. 7 is cylindrical shaped and the vacuum chamber (81) is inside the cylindrical porous printing table and also cylindrical shaped.

The printing table in a preferred embodiment of the inkjet printing system may move under an inkjet print device (FIG. 4.) or valve-jet print device or a gantry may move a inkjet print device (FIG. 5) or valve-jet print device over the printing table. These so called flat-table digital printers (FIG. 4, FIG. 5) most often are used for the printing of planar substrates or ridged substrates or sheets of flexible substrates. They may incorporate IR-dryers or UV-dryers to prevent prints from sticking to them as they are produced. An example of a wide-format printer and more specific a flat-table digital printer is disclosed in EP1881903 B (AGFA GRAPHICS NV).

Several technologies for inkjet printing systems are used according the ink that is used in these inkjet printing systems. Examples of ink types for inkjet printing systems are:

Aqueous: this term is for thermal or piezo inkjet printing systems using an ink known as aqueous or water-based. The term water base is a generally accepted misnomer. The pigment is held in a non-reactive carrier solution that is sometimes water and other times a substitute liquid, including a soy based. Aqueous ink generally comes in two flavours, Dye and UV (alternatively known as pigment). Dye ink is high colour, low UV-resistant variety that offers the widest colour gamut. UV ink is generally duller in colour but withstands fading from UV rays. Similar in general principle to desktop inkjet printers. Finished prints using dye inks must be laminated to protect them if they are to be used outdoors while prints using UV inks can be used outdoors un-laminated for a limited time. Various substrates are available, including canvases, banners, metabolized plastic and cloth. Aqueous technology requires that all substrates be properly coated to accept and hold the ink.

Solvent: this term is used to describe any ink that is not water-based. Piezo inkjet printers whose inks use petroleum or a petroleum by-product such as acetone as its carrier liquid. "Eco-solvent" inks usually contain glycol esters or glycol ether esters and are slower drying. The resulting prints are waterproof. May be used to print directly on uncoated vinyl and other substrates as well as ridged substrates such as Foam Board and PVC.

Dye sublimation: inks are diffused into the special substrates to produce continuous-tone prints of photographic quality.

UV: piezo inkjet printing systems whose inks are UV-curable (dry when cured with UV light). The resulting prints are waterproof, embossed & vibrant. Any substrates to be print on can be used in this technology, polymer made substrates are best. Ceramics, glass, metals, and woods are also used to print on with these categorized inkjet printing systems.

The inkjet printing system may mark a broad range of substrates such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexo plates, metal based plates, fibreglass, transparency foils, adhesive PVC sheets and others.

Preferably the inkjet printing system comprises one or more inkjet printheads jetting UV curable ink to mark a substrate and a UV source, as dryer system, to cure the inks after marking. Spreading of a UV curable inkjet ink on a substrate may be controlled by a partial curing or "pin curing" treatment wherein the ink droplet is "pinned", i.e. immobilized and no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing system of a preferred embodiment may be used to create through a sequential layering process by jetting sequential layers, also called additive manufacturing or 3D printing. The objects that may be manufactured additively by a preferred embodiment of the inkjet printing system can be used anywhere throughout the product life cycle, from pre-production (i.e. rapid prototyping) to full-scale production (i.e. rapid manufacturing), in addition to tooling applications and post-production customization. Preferably the object that may be jetted in additive layers by a preferred embodiment of the inkjet printing system is a flexographic printing plate. An example of such a flexographic printing plate manufactured by an inkjet printing system is disclosed in EP2465678 B (AGFA GRAPHICS NV)

The inkjet printing system of a preferred embodiment may be used to create a type of plates used for computer-to-plate (CTP) systems in which a proprietary fluid is jetted onto a metal base to create an imaged plate from the digital record. Creating the image from digital files allows the imaging to occur without the use of lasers or any other type of exposure. The plates require no processing or post-baking and can be used immediately after the ink-jet imaging is complete. Another advantage is that the platesetters with an inkjet printing system is less expensive than laser or thermal equipment that is normally used in computer-to-plate (CTP) systems. Preferably the object that may be jetted by a preferred embodiment of the inkjet printing system is a lithographic printing plate. An example of such a lithographic printing plate manufactured by an inkjet printing system is disclosed EP1179422 B (AGFA GRAPHICS NV)

The inkjet printing system may comprise a valve-jet print device with a valve-jet printhead that comprises a plurality of inline jets that are controlled by valves to mark a substrate. The valves open and shut independently to produce streams of intermittent ink droplets.

A printing zone in a preferred embodiment of the inkjet printing zone is the virtual zone at the top layer of the porous printing table where the ink may be jetted by an inkjet print device or valve-jet print device.

A preferred embodiment of the inkjet printing system may comprised in an industrial inkjet printing system such as textile inkjet printing system, ceramic inkjet printing system or glass inkjet printing system. By the variation in multiple vacuum zones multiple print jobs can be jetted simultaneously which shortens the production time. But an industrial inkjet printing system asks a high reliability of the inkjet printing system. The preferred embodiments of the inkjet printing system results in a higher reliability of the inkjet printing system because the movable vacuum divider with its brush is not influenced by contamination in the vacuum chamber.

Printing near the edges of the substrate such as glass, workpieces or ceramics may also cause contamination in the vacuum chamber due to alignment problems and/or dripping ink while printing a pattern on the substrate. A part of the pattern may be jetted outside the top surface of the substrate which may contaminate the vacuum chamber but the preferred embodiments of the inkjet printing system guarantee that the vacuum chamber may be cleaned by moving the movable vacuum divider in the vacuum chamber.

Preferably the industrial inkjet printing system is a textile inkjet printing system. In industrial textile inkjet printing systems printing on multiple textiles simultaneous is an advantage in producing printed textiles so a porous printing table with movable vacuum divider may enhance the production timings. Also in industrial textile application a lost of time due the malfunctioning of the printing table, e.g. caused by contamination in the vacuum chamber, need to be avoided and is solved by the preferred embodiments of the inkjet printing system. The preferred embodiments of the inkjet printing system guarantee also when printing on porous textiles that the vacuum chamber may be cleaned by moving the movable vacuum divider in the vacuum chamber.

And more preferably the industrial inkjet printing system is a ceramic inkjet printing system. In ceramic inkjet printing systems printing on multiple ceramics simultaneous is an advantage in producing printed ceramics so a porous printing table with movable vacuum divider may enhance the production timings. Also in a ceramic inkjet printing application a lost of time due the malfunctioning of the printing table, e.g. caused by contamination in the vacuum chamber, need to be avoided and is solved by the preferred embodiments of the inkjet printing system.

And most preferably the industrial inkjet printing system is a glass inkjet printing system. In glass inkjet printing systems printing on multiple glasses simultaneous is an advantage in producing printed ceramics so a porous printing table with movable vacuum divider may enhance the production timings. Also in a glass inkjet printing application a lost of time due the malfunctioning of the printing table, e.g. caused by contamination in the vacuum chamber, need to be avoided and is solved by the preferred embodiments of the inkjet printing system.

Porous Printing Table

A porous printing table (80) is a support for a substrate while an inkjet print device is printing on the substrate. For example to avoid registration problems while printing on a substrate or to avoid collisions while conveying a substrate the substrate needs to be connected to the porous printing table. The porous printing table is sometimes called a porous printing plate.

Between the substrate and the printing table may be a porous conveying belt when a porous conveying belt is wrapped around the porous printing table.

Preferably the porous printing table in a preferred embodiment comprises a set of air channels to provide a pressure differential by a vacuum chamber at the top surface of the porous printing table to create a vacuum zone and at the bottom surface of the printing table a set of apertures which are connected to the set of air channels. These apertures at the bottom layer may be circular shaped and/or grooves, such as slits, parallel with the bottom layer of the porous printing table.

An aperture at the bottom surface and/or at the top surface of the porous printing table may be connected to 1 or more air channels. An aperture at the bottom surface or top surface of the porous printing table may be small in size, preferably from 0.3 to 12 mm in diameter, more preferably from 0.4 to 8 mm in diameter, most preferably from 0.5 to 5 mm in diameter and preferably spaced evenly apart on the conveying belt (1) preferably 1 mm to 50 mm apart, more preferably from 4 to 30 mm apart and most preferably from 5 to 15 mm apart to enable the creation of uniform vacuum pressure that connects a substrate together with the porous printing table.

Preferably in a preferred embodiment the air channels at the top layer of the porous printing table are parallel with the porous printing table to enhance the uniform vacuum pressure over the printing table.

A set of apertures at the top layer of the porous printing table may be connected to the air channels. These apertures at the top layer may be circular shaped and/or be grooves, such as slits, parallel with the top layer of the porous printing table. Preferably these grooves are oriented along the width of the porous printing table.

The porous printing table, comprising a vacuum chamber, may be cylindrical shaped or cuboid shaped as for example is disclosed in US 20100213666 (XEROX CORPORATION). For a cylindrical shaped porous printing table the vacuum chamber is preferably inside the cylindrical shaped porous printing table, more preferably the porous printing table comprises a vacuum chamber which is cylindrical shaped.

A cylindrical shaped porous printing table is preferred in a preferred embodiment of inkjet printing system to manufacture a flexographic printing plate or lithographic printing plate. The inkjet printing system may be integrated in a conventional printing press to manufacture a flexographic printing plate or lithographic printing plate.

Preferably the porous printing table of a preferred embodiment comprising a honeycomb structure plate (FIG. 14) which is sandwiched between 2 plates which comprises each a set of apertures connect to one or more air channels in the porous printing table. The honeycomb structure plate results in a better uniform vacuum distribution on the top surface of the porous printing table.

The dimensions and the amount of air channels should be sized and frequently positioned to provide sufficient vacuum pressure to the porous printing table. Also the dimensions and the amount of apertures at the bottom surface of the porous printing table should be sized and frequently positioned to provide sufficient vacuum pressure to the porous printing table. The dimension between two air channels or two apertures at the bottom surface of the porous printing table may be different.

If a honeycomb structure plate is comprised in the porous printing table (FIG. 14) also the dimensions and the amount of honeycomb cores should be sized and frequently positioned to provide sufficient vacuum pressure to the porous printing table. The dimensions between two honeycomb cores may be different.

The top layer of the printing table should be constructed to prevent damaging of a substrate or porous conveying belt if applicable. For example the apertures at the top layer that are connected with the air channels may have rounded edges. The top layer of the printing table may be configured to have low frictional specifications.

The length of a porous printing table in a preferred embodiment of the inkjet printing system is defined by the dimension in the same direction of the longest side of the gantry that comprises one or more inkjet print devices and/or one or more valve-jet print devices. The gantry may move one or more inkjet print devices and/or one or more valve-jet print devices along the longest side of the gantry.

The width of the porous printing table in a preferred embodiment of the inkjet printing system is the dimension in the direction perpendicular the length of the porous printing table.

The porous printing table is preferably parallel to the ground whereon the inkjet printing system is connected to avoid misaligned printed patterns.

The porous printing table in a preferred embodiment of the inkjet printing system may be wrapped by a porous conveying belt, linked by minimal 2 pulleys, wherein the porous conveying belt carries a substrate by moving from a start location to an end location. Preferably the porous conveying belt moves in successive distance movements also called discrete step increments. The vacuum pressure in a vacuum zone on the top surface of the porous printing table may couple the substrate and the porous printing table by sandwiching the porous conveying belt that carries the substrate. The vacuum pressure in a vacuum zone on the top surface of the porous printing table may apply sufficient normal force to the porous conveying belt when the conveying belt is moving and carrying a substrate in the conveying direction. The vacuum pressure may also prevent any fluttering and/or vibrating of the conveying belt or substrate on the conveying belt.

The inkjet printing system may provide vacuum zones, preferably related to a sub-vacuum chamber that is created by a moving vacuum divider, at an edge of the porous conveying belt to correct the flatness, resilience, oblique movement correction, position of the porous conveying belt on the pulleys and/or the tension of the porous conveying belt by applying a different vacuum pressure in the vacuum zone at the edge of the porous conveying belt.

Preferably an inkjet print device or a valve-jet print device is moving above the top surface of the printing table along the length of the conveying belt, which is the direction between the edges of the conveying belt and thus across the conveying direction. The moving of the inkjet print device may occur while the inkjet print device or valve-jet print device is jetting a pattern on a substrate that is carried by the conveying belt. The vacuum pressure in a vacuum zone may be adapted while an inkjet print device or valve-jet print device is printing.

Figure 11:
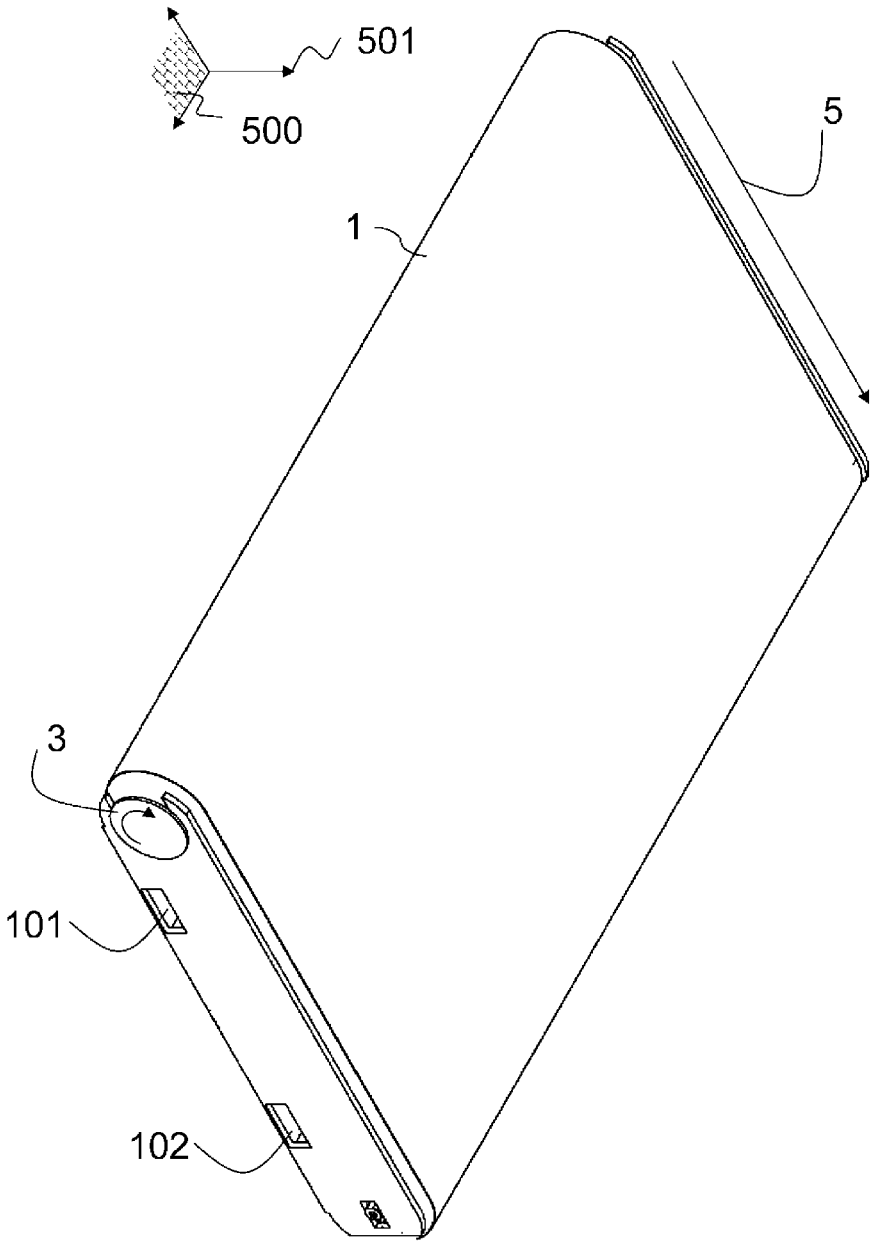
FIG. 11, FIG. 12 and FIG. 13 illustrates the same preferred embodiment of the inkjet printing system wherein the porous printing table (80) is wrapped by a porous conveying belt (1) which is linked by an idle pulley (2) and a powered pulley (3). A substrate may move on the porous conveying belt (1) in the conveying direction (5). The vacuum pump is not shown.

To attach the porous printing table in a preferred embodiment of the inkjet printing system the porous printing table may have two apertures to be able to navigate the printing table with a fork-truck while constructing the inkjet printing system. The inner surface of the two apertures has a dimension that is suitable for a fork of a fork-truck (FIG. 11, FIG. 12, FIG. 13).

The porous printing table of a preferred embodiment of the inkjet printing system may comprise underneath a plurality of vacuum chambers wherein at least one has a movable vacuum divider, such as a moving wall.

Preferably in a preferred embodiment of the inkjet printing system the plurality of vacuum chambers are positioned in a row along the length of the porous printing table (FIG. 9) of the plurality of vacuum chambers are positioned in a row along the width (FIG. 10) of the porous printing table.

Preferably in a preferred embodiment of the inkjet printing system the plurality of vacuum chambers are positioned in a matrix, that is in rows and columns, underneath the porous printing table.

Preferably a vacuum chamber in a preferred embodiment of the inkjet printing system is sealed against the porous printing table to prevent vacuum leakage.

Vacuum Chamber

A vacuum chamber (81) is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump, such as a ring blower, may provide a vacuum pressure inside a sub-vacuum chamber of a preferred embodiment of the printing system so a substrate is connected to the top surface of the porous printing table at the vacuum zone that is related to a sub-vacuum chamber. The vacuum pump may keep a sub-vacuum chamber below ambient pressure to create enough vacuum pressure via one or more air channels in the porous printing table at the vacuum zone on the top surface of the porous printing table that is related to the sub-vacuum chamber. The vacuum pump may be connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

A vacuum pump may also provide vacuum pressure inside a plurality of sub-vacuum chambers of s preferred embodiment of the printing system. By a plurality of vacuum pump connectors from the vacuum pump to a vacuum pump input vacuum pressures may be provided in a plurality of sub-vacuum chambers. One or more vacuum pump connectors of the plurality of vacuum pump connectors may have a vacuum controller to control the vacuum in the connected sub-vacuum chambers.

Preferably the vacuum pump itself may have a vacuum controller to control the vacuum in the connected sub-vacuum chambers.

A preferred embodiment of the inkjet printing system may comprise a vacuum measurement system to measure the vacuum in a sub-vacuum chamber in the vacuum chamber. The measuring of the vacuum may be done while a movable vacuum divider is moving in the vacuum chamber to another position in the vacuum chamber and/or while printing a pattern on a substrate and/or while supplying a substrate on the porous printing table.

To prevent contamination, such as paper dust, substrate fibers, ink, ink residues and/or ink debris such as cured ink, to contaminate via the air channels of the porous printing table the interior of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

The width of a vacuum chamber, which is in the same direction of the width of the above porous printing table, may be smaller to make the possibilities to create place underneath the printing table for means to provide vacuum in the sub-vacuum chambers such as a vacuum pump or a vacuum pump connector.

The length of a vacuum chamber, which is in the same direction of the length of the above porous printing table, may be smaller to make the possibilities to create place underneath the printing table for means to provide vacuum in the sub-vacuum chambers such as a vacuum pump or a vacuum pump connector.

Movable Vacuum Divider

Figure 8:
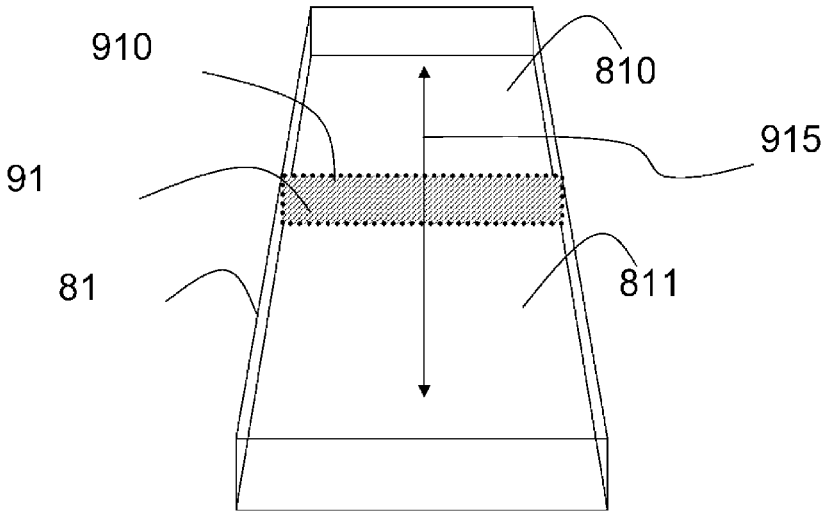
FIG. 8 illustrates a vacuum chamber (81) in a preferred embodiment of the inkjet printing system that is positioned and attached underneath a porous printing table, which is not shown. The vacuum chamber (81) comprises a movable vacuum divider (91) which is wrapped by a brush (910). The movable vacuum divider (91) may move along the arrow (915). The movable vacuum divider divides the vacuum chamber (91) in two sub-vacuum chambers (810, 811). The movable vacuum divider (91) is parallel to the width of the porous printing table to create a row of two sub-vacuum chambers (810, 811) along the length of the porous printing table. The sub-vacuum chambers (810, 811) create each their own vacuum zone on the top layer of the porous printing table.
Figure 9:
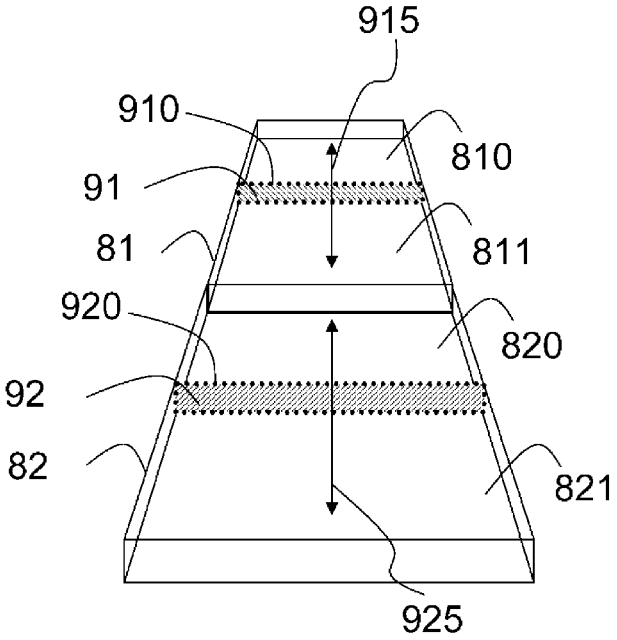
FIG. 9 illustrates a preferred embodiment of the inkjet printing system wherein two vacuum chambers (81, 82) are positioned and attached underneath the porous printing table, which is not shown. Each vacuum chamber (81, 82) comprises a movable vacuum divider (91, 92) which is wrapped by a brush (910). The movable vacuum divider (91, 92) may move along the arrow (915, 925). Each movable vacuum divider divides the vacuum chamber (91, 92) in two sub-vacuum chambers (810, 811, 820, 821). The movable vacuum divider (91, 92) is parallel to the width of the porous printing table to create a row of two sub-vacuum chambers (810, 811, 820, 821) along the length of the porous printing table. The sub-vacuum chambers (810, 811, 820 and 821) create each their own vacuum zone on the top layer of the porous printing table. In the preferred embodiment illustrated by FIG. 9 four vacuum zones are created on the top-layer of the porous printing table.
Figure 10:
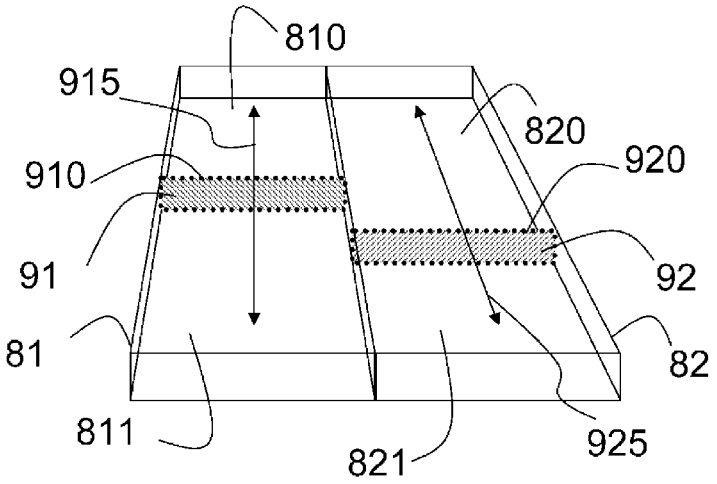
FIG. 10 illustrates another preferred embodiment of the inkjet printing system wherein two vacuum chambers (81, 82) are positioned and attached underneath the porous printing table, which is not shown. Four vacuum zones are created on the top-layer of the porous printing table in a matrix (two rows×two columns) wherein each vacuum zone is related to a sub-vacuum chamber underneath the porous printing table. The two movable vacuum dividers (91, 92) are wrapped by a brush.

To ensure adequate control of substrate having different sizes, the vacuum chamber may comprise at least one movable vacuum divider to create variable sized vacuum zone on the top layer of the porous printing table (FIG. 8. FIG. 9. FIG. 10, FIG. 13).

The moving of the movable vacuum divider may be performed manually but preferably the moving of the movable vacuum divider is driven by a drive system, also called the movable vacuum divider driver. An example of a drive system for a movable vacuum divider in a preferred embodiment of the inkjet printing system may be a basic travelling-nut linear actuator wherein a rotating screw, moves a nut which is comprised in the movable vacuum divider so the movable vacuum divider moves. A movable vacuum divider driver may move more than one movable vacuum divider in the vacuum chamber.

The movable vacuum divider creates a plurality of sub-vacuum chambers wherein a vacuum zone on the top layer of the porous printing table is related to one sub-vacuum chamber. Preferably the movable vacuum divider creates two sub-vacuum chambers.

A vacuum zone on the top layer of the porous printing table is a virtual zone on the porous printing table wherein the vacuum pressure may changed by controlling the vacuum pressure settings of the sub-vacuum chamber in the vacuum chamber which is related to the vacuum zone.

Preferably the movable vacuum divider in a preferred embodiment of the inkjet printing system is a movable wall that divides the vacuum chamber in two sub-vacuum chambers. The movable wall may be parallel to the width of the porous printing table to divide the vacuum chamber in two sub-vacuum chambers and to divide along the width the porous printing table in two vacuum zones on the top surface of the porous printing table. The movable wall may also be parallel to the length of the porous printing table to divide the vacuum chamber in two sub-vacuum chambers and to divide along the length the porous printing table in two vacuum zones on the top surface of the porous printing table.

The vacuum pressure inside a sub-vacuum chamber may be configured to ensure that the vacuum pressure is needed and otherwise turned-off. The possibility to turn-off a virtual zone if not needed on the top surface of the printing table avoids possible extra contamination such as dust sucked in the vacuum chamber via the unused air channels in the porous printing table.

The inkjet printing system may comprise one or more sensors to measure a dimension of a substrate and to communicate to a movable vacuum divider driver for adapting the vacuum zone on the top surface of the porous printing table by moving a movable vacuum divider in the vacuum chamber. The vacuum pressure settings of the sub-vacuum chamber formed by the movable vacuum divider may be adapted depending on the dimension of the substrate.

Also to ensure adequate control of substrate having different weights, two sub-vacuum chambers formed by a movable vacuum divider in the vacuum chamber may have a different vacuum pressure settings that can be selectively adjusted based on the weight of the print medium.

The inkjet printing system may comprise a weight sensor to weight a substrate that is or shall be connected to the porous printing table wherein the weight sensor communicate the weight to adjust the vacuum pressure in the vacuum zone and its belonging sub-vacuum chamber wherein the weighed substrate is or shall be positioned.

If the porous printing table in a preferred embodiment of the inkjet printing system is wrapped by a porous conveying belt wherein the porous conveying belt carries a substrate by moving from a start location to an end location, a movable vacuum divider in the vacuum chamber may be positioned in the vacuum chamber to divide the vacuum chamber in a sub-vacuum chamber to provide a vacuum zone before the printing zone or may be positioned to divide the vacuum chamber in a sub-vacuum chamber after the printing zone.

The advantage to have a vacuum zone with adapted vacuum pressure before the printing zone is to get a better holding of the substrate on the porous conveying belt at the arrival of the edge of the substrate in the printing zone and the advantage to have a vacuum zone with adapted vacuum pressure after the printing zone is to get a better holding of the substrate on the porous conveying belt at the leaving of the edge of the substrate in the printing zone.

These advantages may also be solved by providing an extra vacuum chamber underneath the porous printing table before the printing zone and/or by providing an extra vacuum chamber underneath the porous printing table after the printing zone. Preferably these extra vacuum chambers may have a movable vacuum divider to divide their vacuum chambers in a plurality of sub-vacuum chambers positioned in a row in the direction of the length of the porous printing table.

Preferably the movable vacuum divider in a preferred embodiment of the inkjet printing system comprises a brush that touches the inner surface of a vacuum chamber and the bottom surface of the porous printing table. A hair or a plurality of hairs of the brush may touch the inner surface of an aperture in the bottom surface of the porous printing table.

Preferably the brush in a preferred embodiment of the inkjet printing system is wrapped around the movable vacuum divider.

To prevent that the hairs of the brush in a preferred embodiment of the inkjet printing system shall be broken or shall be cut-off when touching the inner surface of a one of the apertures in the bottom surface of the porous printing table, preferably the aperture is rounded at the edge of the aperture.

To clean the inner surface of the vacuum chamber and/or the bottom surface of the porous printing table and/or a part of the set of apertures in the bottom surface the movable vacuum divider may be moved from one position in the vacuum chamber to another position in the vacuum chamber. Preferably this moving is repeated more than once. The vacuum pressure in a sub-vacuum chambers created by the moving movable vacuum divider may be varied by a vacuum controller while moving to have a better cleaning result.

Brush

A brush is a tool with a plurality of hairs, also called bristles, wire or filaments. The brush is used for cleaning a surface. The brush in a preferred embodiment of the inkjet printing system is comprised in a movable vacuum divider. Contamination passing the brush may be captured and may be held by the plurality of hairs.

The minimum distance between the movable vacuum divider, without the brush, and the inner surface of the vacuum chamber may be from 0.1 mm to 10.00 mm, preferably from 0.20 mm to 5.00 mm and most preferably from 0.50 mm to 10.00 mm.

The minimum distance between the movable vacuum divider, without the brush, and the bottom surface of the porous printing table may be from 0.1 mm to 10 mm, preferably from 0.2 mm to 5 mm and most preferably from 0.5 mm to 10 mm. The length of a hair in the brush may be from 0.05 mm to 10.50 mm, preferably from 0.05 mm to 5.50 mm, preferably from 0.15 mm to 5.50 mm and most preferably from 0.45 mm to 10.50 mm.

The brush comprised in the movable vacuum divider may be rotatable around an axis to get a better cleaning effect in the vacuum chamber.

The filaments of the brush in a preferred embodiment of the inkjet printing system preferably may comprise a fluoropolymer. It is found in a preferred embodiment of the inkjet printing system if the filaments of the brush comprise a fluoropolymer, a fluorocarbon based polymer with multiple strong carbon-fluorine bond, because the characterization of a high resistance to solvents, acids, and bases.

In a preferred embodiment of the inkjet printing system the brush is a carpet fabric (FIG. 15, FIG. 16). It was surprisingly found that a carpet fabric as brush in a preferred embodiment of the inkjet printing system also prevent memory leakage at the sides of the movable vacuum divider besides the cleaning purposes of the carpet fabric as brush. We presume that the laying down of some hairs in the brush prevent memory leakages.

Another advantage of the carpet fabric is the higher freedom of having more inaccurate dimensions of the porous printing table, vacuum chamber and movable vacuum divider. This higher design freedom makes the construction of the porous printing table cheaper.

Preferably the carpet fabric, as brush, in a preferred embodiment of the inkjet printing system is attached and more preferably wrapped around the movable vacuum divider.

A pile of a carpet fabric is the visible surface of the carpet fabric, after attaching the primary back to a means, consisting of yarn tufts in loop and/or cut configuration. A pile of a carpet fabric is also called the face or the nap of the carpet fabric.

The carpet-backing fabric of a carpet fabric is a means into which the yarn tufts are inserted. The primary back may be made of jute, kraftcord, cotton, woven or non-woven synthetics; preferably the carpet-backing fabric of the carpet fabric in a preferred embodiment comprises polypropylene.

Pile height is the length (expressed in decimal parts of one inch) of the yarn tuft from the carpet-backing fabric to the top surface of the carpet fabric. A carpet fabric with a higher pile height will possess more yarn on the carpet-backing fabric and will essentially be more durable. The pile height of the carpet fabric in a preferred embodiment is from 0.1 to 20 mm and preferably from 0.2 mm to 10 mm, and more preferably from 0.5 mm to 5 mm and most preferably from 1 mm to 5 mm.

The carpet fabric density of the carpet fabric may be from 500 $cm^2$ until 100000 filaments per $cm^2$; preferably be from 2000 $cm^2$ until 110000 filaments per $cm^2$ The pile of the carpet fabric as brush in a preferred embodiment of the inkjet printing system may be composed of polytetrafluoroethylene (PTFE), polypropylene (PP), polyurethane, polyester, aromatic polyamides (ARAMID), rayon, acrylic, cellulose, viscose or nylon, preferably composed of polytetrafluoroethylene (PTFE).

Preferably in a preferred embodiment of the inkjet printer system the inner surface of an aperture of the set of apertures in the bottom surface is touched by a part of the pile.

Preferably the loosing of filaments in the carpet fabric as brush in a preferred embodiment of the inkjet printing system must be minimized by:

ultrasonic cutting of the edges of the carpet fabric; and/or removing the loose filaments during or after cutting.

The distance between the carpet fabric and the bottom surface of the porous printing table may be smaller than the height of the pile.

To provide softness and/or adequate support and/or pre-tensioning system when moving the movable vacuum divider, a cushion may be provided between the carpet fabric and the movable vacuum divider of a preferred embodiment of the inkjet printing system. Preferably the cushion comprises foam, rubber, urethane or PVC.

Other characterization of the carpet fabric as brush in a preferred embodiment of the inkjet system may be:

antimicrobial carpet fabric; and/or antistatic carpet fabric; and/or dimensional stable carpet fabric.

Belt Conveyor System

A preferable preferred embodiment of the inkjet printing system comprises a belt conveyor system wherein a porous conveying belt is linked on a minimum of two pulleys to carry the substrate and wherein the conveyor is wound, also called wrapped, around the porous printing table.

The belt step conveyor system may be driven by an electric motor to producing a torque to a pulley so by friction of the porous conveying belt on the powered pulley the porous conveying belt and a substrate is moved from a start location to an end location in a conveying direction.

The direction movement from the start location to the end location is called the conveying direction.

The length of a conveying belt in a preferred embodiment of the inkjet printing system is defined by the dimension in the same direction of the longest side of the gantry that comprises one or more inkjet print devices and/or one or more valve-jet print devices. The length of a conveying belt is preferably smaller than the length of the porous printing table of a preferred embodiment of the inkjet printing system.

To correct the flatness, resilience, oblique movement correction, position of the porous conveying belt on the pulleys and/or the tension of the porous conveying belt several solutions are used in belt conveyor systems. An example is to make the pulleys slightly convex in order to keep the porous conveying belt centred. Another example of a belt conveyor system comprising oblique movement correction mean by controlling an extra pulley is disclosed in U.S. Pat. No. 7,823,720 B (SEIKO EPSON CORP.).

Belt Step Conveyor System

A preferred embodiment of the inkjet printing system which comprises a belt conveyor system, wrapped around the porous printing table, preferably comprises a belt step conveyor system as belt conveyor system wherein the conveying belt carries a substrate by moving from a start location (40) to an end location (41) in successive distance movements also called discrete step increments. (FIG. 1, FIG. 2, FIG. 3, FIG. 6, FIG. 7, FIG. 11, FIG. 12, FIG. 13)

Figure 1:
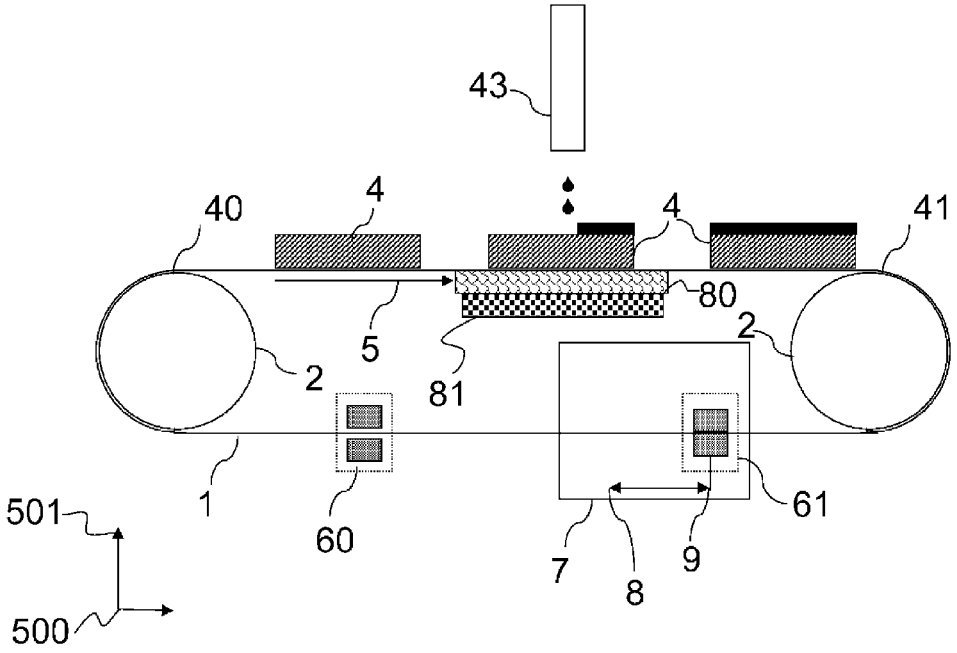
FIG. 1 illustrates a preferred embodiment of the inkjet printing system (in two-dimensions) wherein the porous printing table (80) is wrapped by a porous conveying belt (1) which is linked by 2 pulleys (2). A substrate (4) is moved in the conveying direction (5) underneath an inkjet print device (43) which jets a liquid on the substrate. The substrate (4) is coupled to the porous printing table (80) so the conveying belt (1) is sandwiched between the substrate (4) and the porous printing table (80). Underneath the porous printing table (80) a vacuum chamber (81) is comprised to provide a vacuum pressure to couple the substrate (4) to the porous printing table (80). The movable vacuum divider inside the vacuum chamber (81) is not shown. The arrow (501) defines the direction from ground (500) to top.
Figure 2:
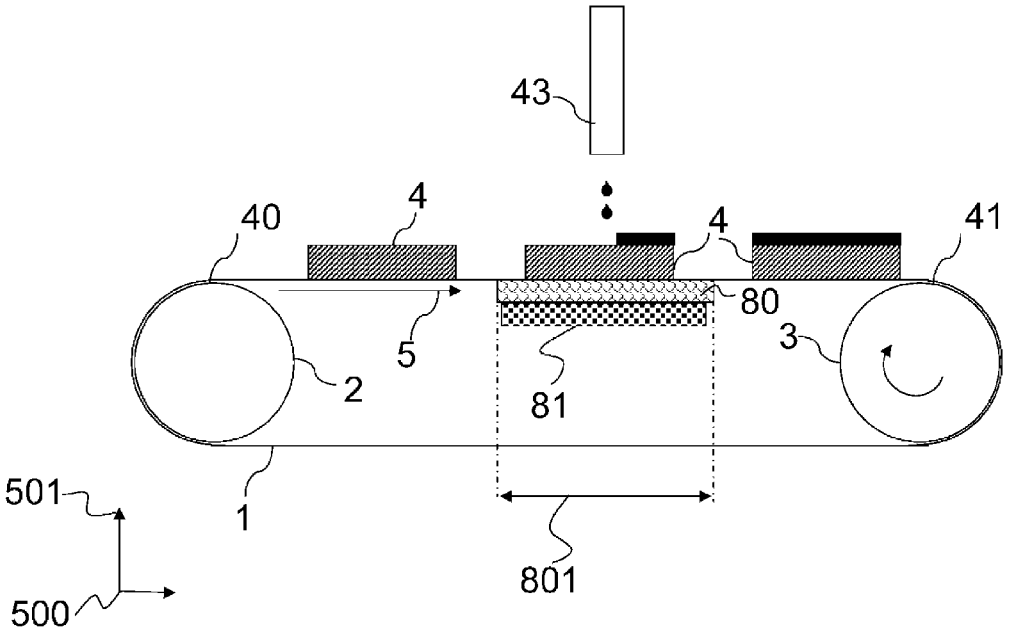
FIG. 2 illustrates a preferred embodiment of the inkjet printing system wherein the porous printing table (80) is wrapped by a porous conveying belt (1) which is linked by two pulleys (2, 3). Most parts are similar as in FIG. 1 only the drive system to move the conveyor belt (1) is different. The conveying belt is in this figure driven by a power pullet (3). The double arrow (801) illustrates the width of the porous printing table (80).
Figure 3:
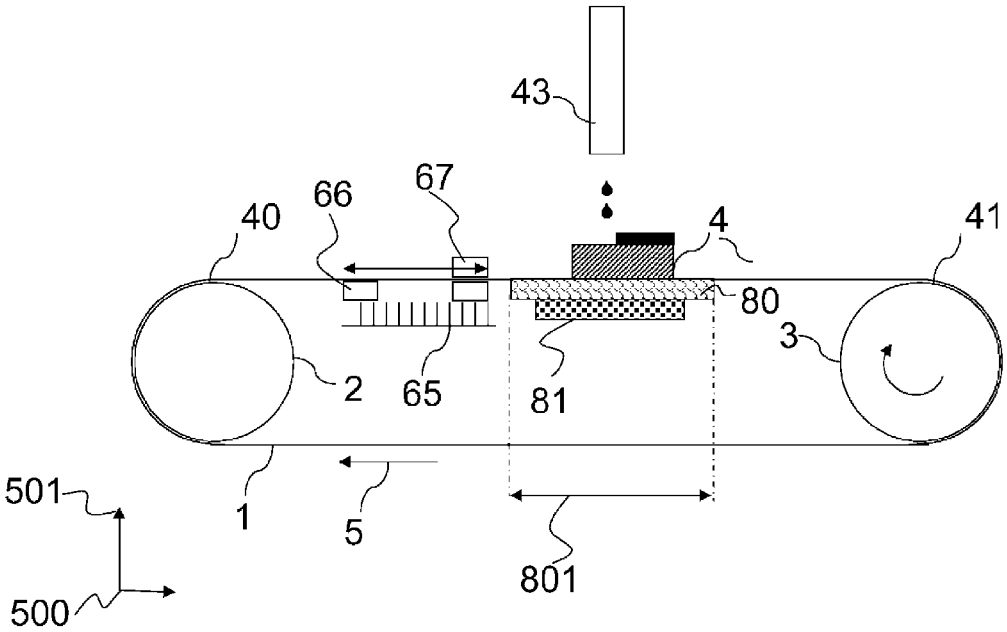
FIG. 3 illustrates a preferred embodiment of the inkjet printing system wherein the porous printing table (80) is wrapped by a porous conveying belt (1) which is linked by two pulleys (2, 3). Most parts are similar as in FIG. 1 only a measuring device is comprised to measure the linear feed of the porous conveying belt (1), which comprises a position sensor (67) that may attachable to the porous conveying belt and a stationary reference (66) wherein the relative position of the position sensor to the stationary reference (66) is detected. The position sensor (67) comprises an optical sensor which interprets the distance between the position sensor (67) and the stationary reference (67) on a distance ruler (65).

The belt step conveyor system may be driven by an electric stepper motor to produce a torque to a pulley so by friction of the porous conveying belt on the powered pulley the porous conveying belt and the load is moved in a conveying direction (FIG. 2). The use of an electric stepper motor makes the transport of a load more controllable e.g. to change the speed of conveying and move the load on the porous conveying belt in successive distance movements.

An example of a belt step conveying belt system with an electric stepper motor is described for the media transport of a wide-format printer in EP 1235690 A (ENCAD INC)

To known the distance of the successive distance movements in a belt step conveyor system, that is driven by an electric stepper motor to produce a torque to a pulley so by friction of the porous conveying belt on the powered pulley the porous conveying belt and the load is moved in a conveying direction substrate on the porous conveying belt, so it can be communicated to other controllers such as a renderer of the inkjet printing system or the controllers of a inkjet head, an encoder is comprised on one of the pulleys that are linked with the porous conveying belt But preferably the encoder measures the linear feed of the porous conveying belt directly on the porous conveying belt (FIG. 3) by a measuring device comprising a position sensor (67) that may attachable to the porous conveying belt and a stationary reference (66) wherein the relative position of the position sensor to the stationary reference (66) is detected. The position sensor (67) comprises preferably an optical sensor which may interpret the distance between the position sensor (67) and the stationary reference (67) on a distance ruler (65), such as an encoder strip, which is preferably comprised at the stationary reference (66). Preferably the measuring device comprises a gripper to grip the position sensor (67) to the conveying belt. The measuring device may comprising a guide through which the position sensor (67) relative to the stationary reference is guided—preferably linear. By attaching the position sensor (67) to the porous conveying belt while moving the porous conveying belt in a conveying direction (5), the distance can be measured between the position sensor (67) and the stationary reference (66). Between the discrete steps increments the position sensor (67) may release the porous conveying belt (1) and may return to the stationary reference (66).

To enhance the accuracy of this measuring device (FIG. 3) the porous inkjet table which is wrapped with the conveying belt may provide vacuum zones, preferably related to a sub-vacuum chamber that is created by a moving vacuum divider, at an edge of the porous conveying belt to correct the flatness, resilience, oblique movement correction, position of the porous conveying belt on the pulleys and/or the tension of the porous conveying belt by applying a different vacuum pressure in the vacuum zone at the edge of the porous conveying belt.

The belt step conveyor system may also be driven in a preferred embodiment by a drive system (FIG. 1) that comprises:

a driver to drive and control a first linear movement system (7);

a first belt gripper (61) that has a first engager to engage the porous conveying belt (1) when the first belt gripper is moved by the first linear movement system (7) from a home position (8) to an end position (9) and that has a first release mean to release the porous conveying belt (1) when the first belt gripper (61) is moved by the first linear movement system (7) from the end position (9) to the home position (8);

a second belt gripper (60) that has a second release to release the porous conveying belt (1) when the first belt gripper (61) is moved by the first linear movement system (7) from the home position (8) to the end position (9) and that has a second engager to engage the porous conveying belt (1) when the first belt gripper (61) is moved by the first linear movement system (7) from the end position (9) to the home position (8).

The advantageous effect of this latest preferred embodiment is that no slip occurs contrary to the belt step conveyor systems driven by a stepper motor to power a pulley. The exact positioning capabilities are also accurate and less tension force is needed on the porous conveying belt to strengthen the resilience and tensioning of the porous conveying belt. Other advantages are the ease of implementation and use of the linear movement system in a preferred embodiment of the belt step conveyor system to calculate the exact positioning of the load on the porous conveying belt and the engaging of the second belt gripper while the first belt gripper is returning to its end position to ensure the stagnation of the porous conveying belt and a substrate on the porous conveying belt. This gives a more accurate positioning capability.

In the latest preferred embodiment the drive-system of this step belt conveyor system may have a plurality of moving belt grippers to enlarge the force to carry the load on a porous conveying belt from a start location to an end location. The force to carry the load on the porous conveying belt from start location to end location can be divided by the linear movement systems of the plurality of moving belt grippers.

The advantage is that it solves the need of linear movement systems with less linear force and thereby obtaining a better control to drive the belt step conveyor system.

In the latest preferred embodiment the drive-system of this step belt conveyor system may comprise a plurality of moving belt grippers mounted at each border, thus the left and the right border, of the porous conveying belt. This allows to better control the straightness of the conveying path of the porous conveying belt and a higher accuracy of position capabilities especially transverse to the conveying direction.

An electro-magnet in a belt gripper in the latest preferred embodiment may be used. The belt gripper shall engage instantly the porous conveying belt if the electro-magnet is powered on. The release of the porous conveying belt is instantly done by powering off the electro-magnet. The instantly engaging and releasing from the belt gripper with an electro-magnet has the advantage of very high positioning capabilities. A belt gripper may also comprising pneumatic cylinders.

An encoder system may be mounted on the linear movement system, so the position of the moving belt gripper and distance of the successive distance movements of a substrate on the porous conveying belt can be communicated.

Porous Conveying Belt

The porous conveying belt is made of at least one material such as a metal belt. Preferably the porous conveying belt (1) includes magnetically attractable material such as a metal porous conveying belt (1) and/or the porous conveying belt (1) has one layer of a woven fabric web. More preferably the porous conveying belt (1) has two or more layers of materials wherein an under layer provides linear strength and shape, also called the carcass and an upper layer called the cover or the support side. The carcass is preferably a woven fabric web and more preferably a woven fabric web of polyester, nylon or cotton. The material of the cover is preferably various rubber and more preferably plastic compounds and most preferably thermoplastic. But also other exotic materials for the cover can be used such as silicone or gum rubber when traction is essential. Preferably one of the engage-zones on the porous conveying belt (1) for the belt grippers has less layers and/or thinner layer(s) than in one of the carry-zones to have a faster and better grip. An example of a multi-layered conveying belt for a general belt conveyor system wherein the cover having a gel coating is disclosed in US 20090098385 A1 (FORBO SIEBLING GMBH).

Preferably the porous conveying belt is a glass fabric or the carcass is glass fabric and more preferably the glass fabric has a coated layer on top with a thermoplastic polymer and most preferably the glass fabric has a coated layer on top with polytetrafluoroethylene also called PTFE.

The porous conveying belt may also have a sticky cover which holds the load on the porous conveying belt while it is carried from start location to end location. Said porous conveying belt is also called a sticky porous conveying belt. The advantageous effect of using a sticky porous conveying belt allows an exact positioning of the load on the sticky porous conveying belt. Another advantageous effect is that the load shall not be stretched and/or deformed while the load is carried from start location to end location. The adhesive on the cover is preferably activated by an infrared drier to make the porous conveying belt sticky. The adhesive on the cover is more preferably a removable pressure sensitive adhesive.

If a gripper that may be attached to the porous conveying belt is applicable in one of the preferred embodiments, preferably at the zone wherein the gripper is attaching the porous conveying belt (1) by a gripper has less layers and/or thinner layer(s) to have a faster and better grip of the porous conveying belt.

Preferably the porous conveying belt is and endless porous conveying belt. Examples and figures for manufacturing an endless multi-layered conveying belt for a general belt conveyor system are disclosed in EP 1669635 B (FORBO SIEBLING GMBH).

Air Cushion Pulley

One of the pulleys that are linked with the porous conveying belt, wrapped around the porous printing table of a preferred embodiment, may comprise an air cushion system to lower the slip on the pulley and the conveying belt. This is called an air cushion pulley. By providing air in an air chamber inside the pulley the air arrives through a plurality of holes out the surface of the perforated pulley so an air cushion effect on the porous conveying belt is achieved. The air flow rate through the plurality of holes may be controlled. The plurality of holes may be small in size, preferably from 0.3 to 2 mm in diameter, more preferably from 0.4 to 5 mm in diameter, most preferably from 0.5 to 10 mm in diameter. The plurality of holes may be spaced evenly apart on the surface of the air cushion pulley, preferably 3 mm to 50 mm apart, more preferably from 4 to 30 mm apart and most preferably from 5 to 15 mm apart to have an advantageous effect by lower the slip on the air cushion pulley and thus the stability of the porous conveying belt. The porous conveying belt is then carried on a film of air around the air cushion pulley which results in a contact-free passing of the conveying belt over the pulley. Preferably the surface of the air cushion pulley is divided in logical zones, also called air cushion zones. An air cushion zone comprises a part of the plurality of holes. The air flow in each air cushion zone can be controlled separately e.g. by changing the air flows the conveying path of the porous conveying belt may be controlled. For each cushion zone the air cushion pulley may comprise an air chamber internally in the pulley.

Reference Signs List

TABLE 1

| | |
|---|---|
| 1. | conveying belt |
| 101. | aperture suitable for a fork of a fork-truck |
| 102. | aperture suitable for a fork of a fork-truck |
| 2. | a pully |
| 3. | a powered pully |
| 4. | a substrate |
| 40. | start location |
| 41. | end location |
| 43. | an inkjet printing device |
| 44. | an UV-dryer |
| 5. | conveying direction |
| 500. | ground |
| 501. | top |
| 51. | moving direction of the porous printing table (80) |
| 52. | moving direction of the inkjet print device (43) |
| 60. | a belt gripper |
| 61. | a belt gripper |
| 7. | a linear movement system |
| 8. | home position |
| 9. | end position |
| 80. | a porous printing table |
| 800. | length of the porous printing table |
| 801. | width of the porous printing table |
| 805. | a top plate |
| 806. | a honeycomb plate |
| 807. | a bottom plate |
| 81. | a vacuum chamber |
| 810. | a sub-vacuum chamber |
| 811. | a sub-vacuum chamber |
| 82. | a vacuum chamber |
| 820. | a sub-vacuum chamber |
| 821. | a sub-vacuum chamber |
| 91. | a movable vacuum divider |
| 910. | a brush |
| 915. | moving direction of the movable vacuum divider |
| 92. | a movable vacuum divider |
| 920. | a brush |
| 925. | moving direction of the movable vacuum divider |
| 95. | a carpet fabric |
| 951. | a yarn tuft |
| 952. | a primary backing |

The invention claimed is:

1. An inkjet printer system comprising:

a porous printing table; and a first vacuum chamber under the porous printing table to hold a substrate on the porous printing table; wherein the porous printing table includes:

a set of air channels;

a bottom surface including a set of apertures connected to one or more air channels of the set of air channels;

the first vacuum chamber includes:

a movable vacuum divider to divide the first vacuum chamber into a first plurality of sub-vacuum chambers, each of the plurality of sub-vacuum chambers including a sub-vacuum chamber controller to pull a vacuum through a portion of the set of air channels and to create a first vacuum zone on a top surface of the porous printing table; and the movable vacuum divider includes a brush contacting an inner surface of the first vacuum chamber and the bottom surface of the porous printing table.

2. The inkjet printer system according to claim 1, wherein the movable vacuum divider includes a movable wall parallel or substantially parallel to a width of the porous printing table to divide the first vacuum chamber into two of the plurality of sub-vacuum chambers.

3. The inkjet printer system according to claim 1, further comprising a pre-tensioning system that pushes the brush against a wall of the first vacuum chamber and/or the bottom surface of the porous printing table with a force in a range of 0.1 N to 200.0 N.

4. The inkjet printer system according to claim 1, wherein the brush includes a carpet fabric in which a pile thereof includes yarn tufts in a loop and/or a cut configuration.

5. The inkjet printer system according to claim 4, wherein an inner surface of an aperture of the set of apertures in the bottom surface contacts a portion of the pile and/or a distance between the carpet fabric and the bottom surface of the porous printing table is smaller than a height of the pile.

6. The inkjet printer system according to claim 1, further comprising:

a porous conveying belt linked to a minimum of two pulleys, that carries the substrate, and is wound around the porous printing table;

a porous conveying belt position corrector that controls the sub-vacuum chamber controllers to strengthen a resilience, and/or to control a straightness of a conveying path, and/or to control a tension of the porous conveying belt, and/or to control a position of the porous conveyor belt on one of the two pulleys;

a drive system to move the porous conveying belt by successive distance movements; and a second drive system to move the movable divider to a position in the first vacuum chamber to create a vacuum zone on the porous printing table depending a position of the substrate on the porous printing table.

7. The inkjet printer system according to claim 1, further comprising:

a second vacuum chamber under the porous printing table and including a second movable vacuum divider to divide the second vacuum chamber into a second plurality of sub-vacuum chambers, at least one sub-vacuum chamber of the second plurality of sub-vacuum chambers including a chamber controller to pull vacuum through a portion of the set of air channels and to create a second vacuum zone on the top surface of the porous printing table; wherein the second movable vacuum divider includes a brush contacting an inner surface of the second vacuum chamber and the bottom surface of the porous printing table; and the first and second vacuum zones are positioned on the top surface of the porous printing table in a row along a length of the porous printing table or along a width of the porous printing table.

8. An inkjet printing method comprising the steps of:

dividing a printing zone on a porous printing table including a plurality of air channels into separate vacuum zones;

moving a movable vacuum divider inside a vacuum chamber, positioned under the porous printing table, to divide the vacuum chamber into a plurality of sub-vacuum chambers;

contacting an inner surface of the vacuum chamber and a bottom surface of the porous printing with a brush that is attached to the movable vacuum divider; and supplying a vacuum to one of the plurality of sub-vacuum chambers.

9. The inkjet printing method according to claim 8, further comprising the steps of:

conveying a substrate on a porous conveying belt that is wound around the porous printing table and linked to a minimum of two pulleys; and moving the porous conveying belt by successive distance movements.

10. The inkjet printing method according to claim 8, wherein the step of contacting the inner surface of the vacuum chamber and the bottom surface of the porous printing table with the brush includes a step of:

contacting an inner surface of a rounded aperture in the bottom surface of the porous printing table, which is connected to an air channel of the plurality of air channels, with the brush.

* * * * *